US010246966B2

(12) United States Patent
Melenyzer

(10) Patent No.: US 10,246,966 B2
(45) Date of Patent: Apr. 2, 2019

(54) DOWNHOLE SEAL ELEMENT OF CHANGING ELONGATION PROPERTIES

(71) Applicant: Schlumberger Technology Corporation, Sugar Land, TX (US)

(72) Inventor: George J. Melenyzer, Cypress, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 909 days.

(21) Appl. No.: 13/917,217

(22) Filed: Jun. 13, 2013

(65) Prior Publication Data

US 2013/0333901 A1 Dec. 19, 2013

Related U.S. Application Data

(60) Provisional application No. 61/660,973, filed on Jun. 18, 2012.

(51) Int. Cl.
*E21B 33/12* (2006.01)
*E21B 33/134* (2006.01)

(52) U.S. Cl.
CPC ..... *E21B 33/1204* (2013.01); *E21B 33/134* (2013.01)

(58) Field of Classification Search
CPC .... E21B 33/1204; E21B 33/134; E21B 33/12; E21B 33/127; E21B 33/129; E21B 33/1243
See application file for complete search history.

(56) References Cited

U.S. PATENT DOCUMENTS 2,138,156 A * 11/1938 Halliburton ..... E21B 33/1204 166/143
2,555,627 A * 6/1951 Baker ..... E21B 33/12 137/71
2,978,029 A * 4/1961 True ..... E21B 23/065 166/117
3,374,838 A * 3/1968 Current ..... E21B 23/06 166/123
3,524,503 A * 8/1970 Baker ..... E21B 33/127 166/187
4,402,517 A * 9/1983 Wood ..... E21B 33/127 166/122
4,784,226 A 11/1988 Wyatt
(Continued)

OTHER PUBLICATIONS

International Search Report and Written Opinion dated Sep. 6, 2013 for International Patent Application No. PCT/US2013/046059, filed on Jun. 17, 2013, 15 pages.

*Primary Examiner* — Daniel P Stephenson

(57) ABSTRACT

An isolation device with seal element having substantial elongation properties at a time of setting and insubstantial elongation properties at time of drill out. That is, the seal element may be constructed of materials that are geared toward providing effective temporary sealing, for example to support stimulation operations. The seal is also tailored to change elongation properties over time such that upon sufficient exposure to downhole conditions the elongation properties may be substantially reduced. Thus, drillable removal of the device and seal element may be readily attained without undue concern over stretchable tearing of the element leading to an accumulation of large debris left behind in the well.

14 Claims, 6 Drawing Sheets

(56) References Cited

U.S. PATENT DOCUMENTS

| | | | | |
|---|---|---|---|---|
| 5,082,062 | A * | 1/1992 | Wood | E21B 23/02 166/214 |
| 5,186,258 | A * | 2/1993 | Wood | E21B 23/02 166/115 |
| 5,271,469 | A | 12/1993 | Brooks et al. | |
| 5,542,473 | A | 8/1996 | Pringle et al. | |
| 5,775,429 | A * | 7/1998 | Arizmendi | E21B 33/128 166/196 |
| 9,175,533 | B2 * | 11/2015 | Standridge | E21B 33/134 |
| 2003/0155124 | A1 * | 8/2003 | Nguyen | C04B 26/10 166/287 |
| 2003/0226668 | A1 | 12/2003 | Zimmerman et al. | |
| 2005/0205265 | A1 * | 9/2005 | Todd | E21B 33/12 166/376 |
| 2011/0048743 | A1 | 3/2011 | Stafford et al. | |
| 2011/0086942 | A1 * | 4/2011 | Robisson | C04B 28/02 523/130 |
| 2011/0259610 | A1 * | 10/2011 | Shkurti | E21B 33/1204 166/386 |
| 2013/0333901 | A1 * | 12/2013 | Melenyzer | E21B 33/1204 166/387 |

* cited by examiner

DOWNHOLE SEAL ELEMENT OF CHANGING ELONGATION PROPERTIES

PRIORITY CLAIM/CROSS REFERENCE TO RELATED APPLICATIONS

The present document claims priority under 35 U.S.C. § 119(e) to U.S. Provisional Patent Application Ser. No. 61/660,973, filed on Jun. 18, 2012, and entitled "Improved Drillability for Composite or Aluminum Bridge and Frac Plugs", the disclosure of which is incorporated herein by reference in its entirety.

BACKGROUND

Exploring, drilling and completing hydrocarbon and other wells are generally complicated, time consuming and ultimately very expensive endeavors. In recognition of these expenses, added emphasis has been placed on efficiencies associated with well completions and maintenance over the life of the well. Over the years, ever increasing well depths and sophisticated architecture have made reductions in time and effort spent in completions and maintenance operations of even greater focus.

Completions and maintenance operations often involve the utilization of isolation mechanisms such as packers, plugs, and other downhole devices. Such devices may be used to sealably isolate one downhole section of the well from another as an application is run in one of the sections. Indeed, a considerable amount of time and effort may be spent achieving such isolations in advance of running the application, as well as in removing the isolation mechanism following the application. For example, isolations for perforating and fracturing applications may involve a significant amount of time and effort, particularly as increases in well depths and sophisticated architecture are encountered. These applications involve the positioning of an isolation mechanism in the form of a plug. More specifically, a bridge plug may be located downhole of a well section to be perforated and fractured. Positioning of the bridge plug may be aided by pumping a driving fluid through the well. This may be particularly helpful where the plug is being advanced through a horizontal section of the well.

Once in place, equipment at the oilfield surface may communicate with the plug over conventional wireline so as to direct setting thereof. In the circumstance of a cased well, such setting may include expanding slips of the plug for a biting interfacing with a casing wall of the well and thereby anchoring of the plug in place. A seal of the plug may also be expanded into sealing engagement with the casing. This may be achieved by way of the seal element swelling or by way of compression on the seal during setting that forces the seal into radial expansion and engagement with the casing. Regardless, both anchored structural security and sealed off hydraulic isolation may be achieved by the plug once it is set.

Once anchored and hydraulically isolated, a perforation application may take place above the plug so as to provide perforations through the casing in the corresponding well section. Similarly, a fracturing application directing fracture fluid through the casing perforations and into the adjacent formation may follow. This process may be repeated, generally starting from the terminal end of the well and moving uphole section by section, until the casing and formation have been configured and treated as desired.

The presence of the set bridge plug as indicated above keeps the high pressure perforating and fracturing applications from affecting well sections below the plug. Indeed, even though the noted applications are likely to generate well over 5,000-10,000 PSI, the well section below the plug is kept isolated from the section thereabove. This degree of secure isolation is achieved due to the durable slips and central mandrel in combination with a reliable seal element as described above.

Unfortunately, unlike setting of the bridge plugs, wireline communication is unavailable for releasing the plugs. Rather, due to the high pressure nature of the applications and the degree of anchoring and sealing required of the plugs, they are generally configured for near permanent placement once set. As a result, removal of the bridge plugs may require a challenging milling or drill-out interventional application.

In recognition of the challenges to plug removal, the types of materials and construction of such isolation mechanisms has changed. For example, cast iron plug construction has given way to aluminum plug construction which is much easier to drill out by way of a conventional coiled tubing application. In fact, newer composite plug construction may be used which is even easier to drill out. Specifically, the composite construction of the slips, mandrel and overall framework of a plug may be of a specific gravity that is well under 2.0, absorb water and/or be degradable by design.

Unfortunately, material choices for the seal element of the plug may not be selected based primarily on ease of subsequent drill out applications. That is, unlike the other framework of the plug, the seal element is intentionally configured with substantial elongation to break properties (e.g. elongation properties), perhaps 200%-400% or more. This allows the seal element to compressibly attain an effective hydraulic isolation as detailed above. However, it presents a significant challenge to effective drill-out of this portion of the plug. Thus, removal of a series of plugs following stimulation may take considerable time.

As a practical matter, an even larger issue is presented by the substantial elongation properties of the seal element. Namely, it is likely that rather than just degrading into fine particles during drill out, the seal element will often stretch and tear off into larger chunks. This may result in clogging of lines at the oilfield surface as the materials are flowed back to surface. Even worse, this debris may not flow back until production, at which time drill out and other cleanout equipment has left the oilfield. Thus, as opposed to tens of thousands of dollars in cleaning out some surface equipment near the time of drill out, the rework may be much more significant. For example, redressing the issue may require hundreds of thousands of dollars in terms of lost time and production spent on shutting down production and re-rigging things for sake of an entirely new cleanout of the well in addition to unclogging lines at surface.

SUMMARY

A drillable isolation device such as a bridge plug is disclosed. The plug includes an anchoring framework that is of insubstantial elongation properties. However, a seal element of the plug is of comparatively substantial elongation properties at the time the plug is set. On the other hand, the elongation properties of the seal element are less substantial during subsequent plug removal.

DETAILED DESCRIPTION

Embodiments are described with reference to certain types of isolation devices. For example, wireline deployed bridge plugs are referenced that may be suited for use in multi-zonal wells during stimulation operations. However, a variety of other isolation devices configured to achieve a temporary seal and subsequent drillable removal may benefit from embodiments of seal elements detailed herein. These may include any number of conventional packer types irrespective of stimulation or any other specific downhole operation. That is, so long as a seal element is provided of initially substantial elongation properties for sake of sealing and subsequently less substantial elongation properties for sake of drillable or millable removal, substantial benefit may be attained. Further, as used herein, the terms "drillable" and "millable" are used interchangeably and neither usage is intended to preclude or distinguish from the other.

Figure 1:
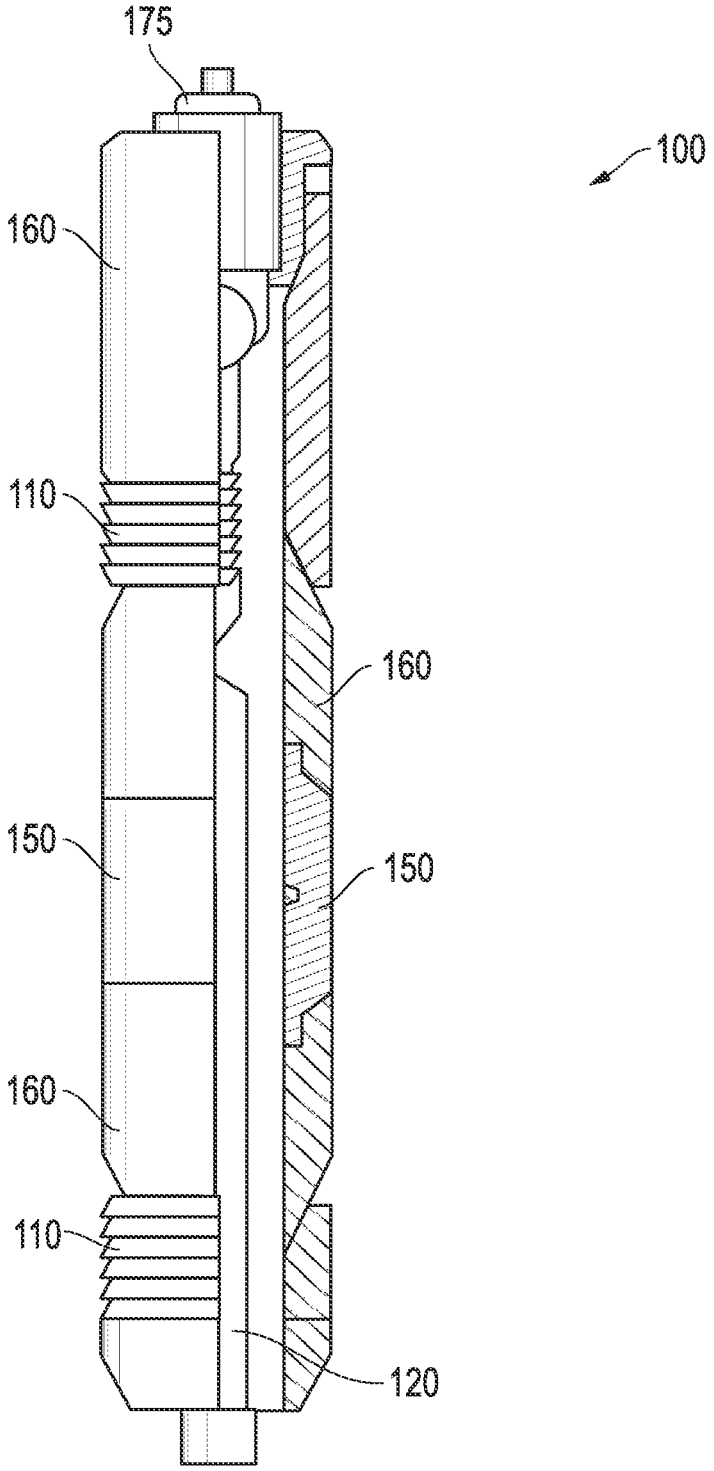
FIG. 1 is a side, partially sectional view of an isolation device incorporating an embodiment of seal element of substantially changing elongation properties.

Referring now to FIG. 1, a side, partially sectional view of an isolation device is shown in the form of a bridge plug 100. In the embodiment shown, the plug 100 includes a coupling 175 for wireline deployment and setting. However, other types of deployment and setting techniques may be utilized. Regardless, the plug 100 incorporates an embodiment of seal element 150 of substantially changing elongation properties. Specifically, as noted above and detailed here below, the element 150 is of a polymer matrix and cement additive that is tailored with elongation properties sufficient to compressibly achieve a temporary seal in a well 280 and later harden for drillable removal (see FIG. 2).

Continuing with reference to FIG. 1, the plug 100 includes a framework of slips 110 and a mandrel 120 that may be of aluminum or other suitable metal-based construction. Alternatively, a sufficiently hard composite for sake of anchoring and subsequent drillable removal may be utilized. In one embodiment, the slips 110 and mandrel 120 contribute to the plug 100 having an overall pressure rating in excess of 10,000 PSI for sake of perforating applications in the well 280 of FIG. 2.

Figure 2:
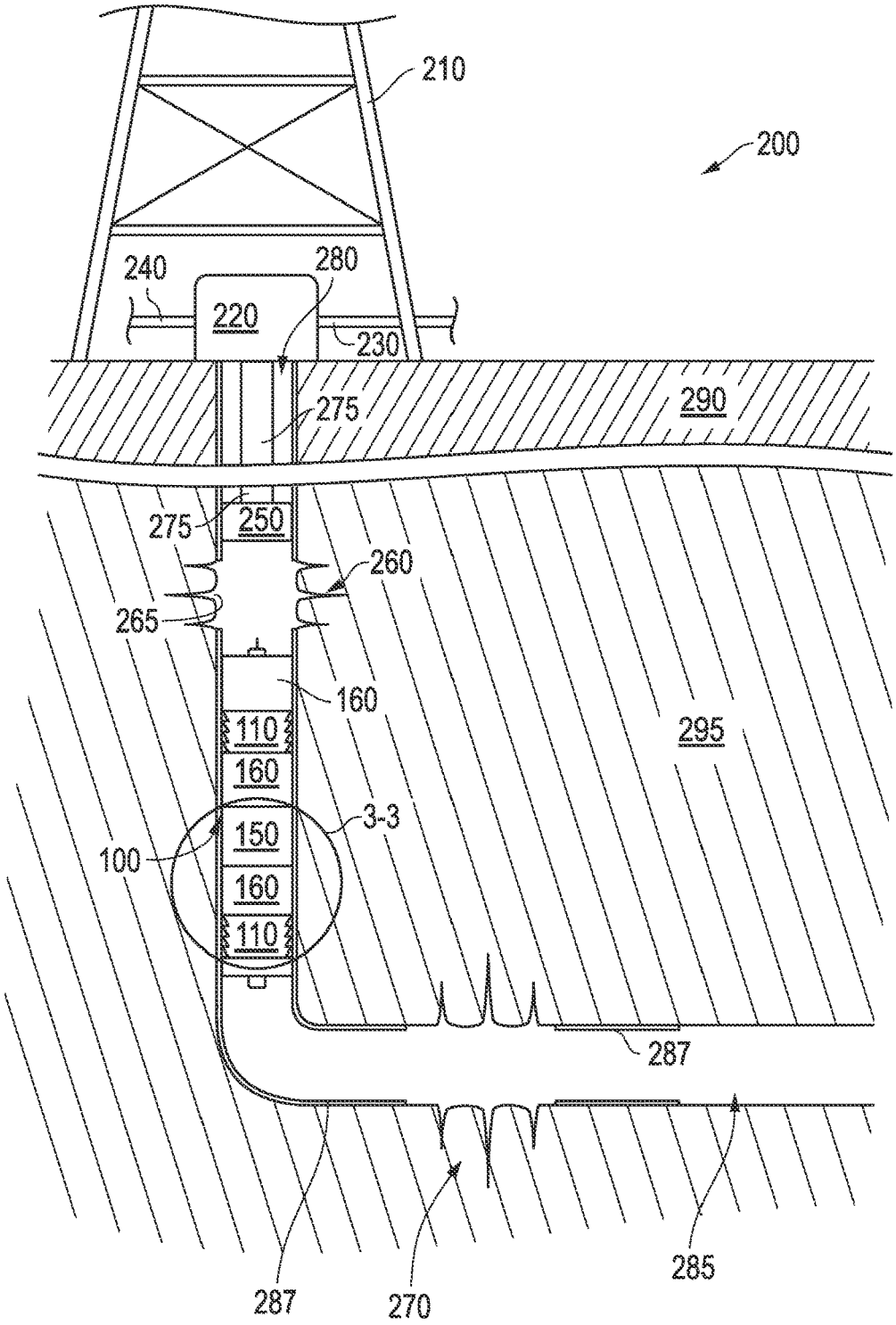
FIG. 2 is an overview depiction of an oilfield with a well accommodating the isolation device of FIG. 1.

With added reference to FIG. 2, in addition to the framework of slips 110 and mandrel 120, the plug 100 includes a compressible seal element 150 that contributes to the initial pressure rating as indicated above. That is, setting of the bridge plug 100 may include bringing body portions 160 closer together toward the center of the plug 100. So, for example, the slips 110 are brought into biting engagement with a well casing 287. Similarly, the polymer makeup of the seal element 150 renders it capable of compressible expansion into sealing engagement with the casing 287. Thus, the noted pressure rating is maintained in terms of sealing by the plug 100 in addition to anchoring by the slips 110.

As indicated, the embodiment of FIG. 1 is a compressible bridge plug 100. However, in other embodiments, the seal element 150 may be of a swellable configuration. That is, the elastomeric polymer makeup may be such that sealable setting is achieved, at least in part, based on exposure of the element 150 to the downhole environment as opposed to strictly compressible forces as noted above. Regardless, at the time of initial sealed engagement, the seal element 150 may be of elongation properties that exceed 200-400% or more. That is, the seal element 150 may be of a polymer matrix that is configured to allow responsively compressible and/or expansive deformation thereof to two to four times its original size.

Referring now to FIG. 2, sealed engagement by the seal element 150 is shown in the environment of an oilfield 200 with a well 280 accommodating the bridge plug 100 of FIG. 1. Specifically, in the embodiment shown, the plug 100 is employed for isolation above a terminal lateral leg 285 of the well 280. As detailed below, this isolation allows for effective perforating and fracturing applications so as to form a vertical production region 260 of perforations 265 above the plug 100. Indeed, this zonal architecture for stimulation may be repeated many times over such that the well 280 is left with a series of different plugs 100 and production regions 260 (and 270). Therefore, subsequent drill-out or milling of the plugs 100 may take place so as to allow for productive flow from the well 280.

Continuing with reference to FIG. 2, a rig 210 is provided at the oilfield surface over a well head 220 with various lines 230, 240 coupled thereto for hydraulic access to the well 280. More specifically, a high pressure line 230 is depicted along with a production line 240. The production line 240 may be provided for recovery of hydrocarbons following completion of the well 280. However, more immediately, this line 240 may be utilized in recovering stimulation fluids and those which are produced in conjunction with milling out or drilling out of the bridge plugs 100. Thus, as detailed further below, this line 240 and other surface equipment are kept substantially unclogged and free of large chunks of debris from the drilled seal element 150. That is, in spite of the initial substantial elongation properties of the seal element 150, it is of a makeup in which these elongation properties are dramatically reduced over time. Therefore, by the time of drill-out, the seal element 150 is more cleanly drilled out into finer, substantially non-clogging, particulate allowing unobstructive fluid recovery (e.g. by the line 240).

In the embodiment of FIG. 2, the well 280, along with production tubing 275, is shown traversing various formation layers 290, 295 and potentially thousands of feet before reaching the noted production region 260. The production tubing 275 may be secured in place uphole of the region 260 by way of a conventional packer 250. As indicated, wireline deployment may be utilized for positioning and setting of the plug 100. However, in other embodiments, slickline, jointed pipe, or coiled tubing may be utilized. Further, setting may be actuated hydraulically or through the use of a separate setting tool which acts compressibly upon the plug 100 for radial expansion of the slips 110 and/or seal element 150.

Figure 3:
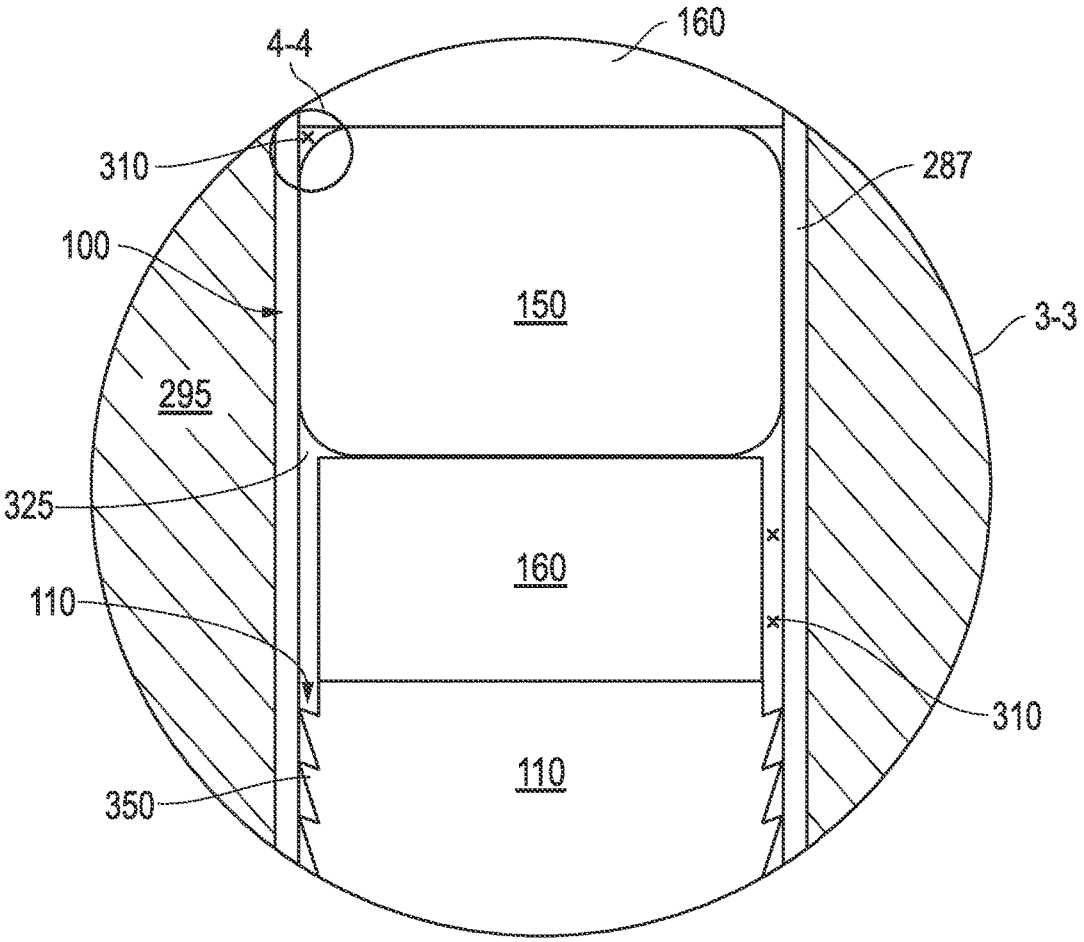
FIG. 3 is an enlarged view of the isolation device and seal element thereof taken from 3-3 of FIG. 2.

Referring now to FIG. 3, an enlarged view of the bridge plug 100 and seal element 150 are shown, taken from 3-3 of FIG. 2. Specifically, the element 150 is shown in compressible sealed engagement with the casing 287. Similarly, teeth 350 of the depicted slip 110 anchor the plug 100 with biting engagement into the casing 287. Once the plug 100 is set in the manner shown, a sufficient pressure rating is achieved so as to allow for stimulation applications to take place in an isolated fashion thereabove (see FIG. 2). For example, structural and sealable integrity of the plug 100 may be maintained in the face of pressures exceeding 10,000 PSI for a fracturing application thereabove.

Continuing with reference to FIG. 3, the seal element 150 remains exposed to a well space 325 and wellbore constituents 310 therein. For example, wellbore fluid of the space 325 may include water, brine, hydrocarbons and various other fluid constituents. In light of this available exposure, the seal element 150 may be constructed of a material matrix that allows for intentionally altering elongation properties thereof as noted above and detailed further below.

Figure 4A:
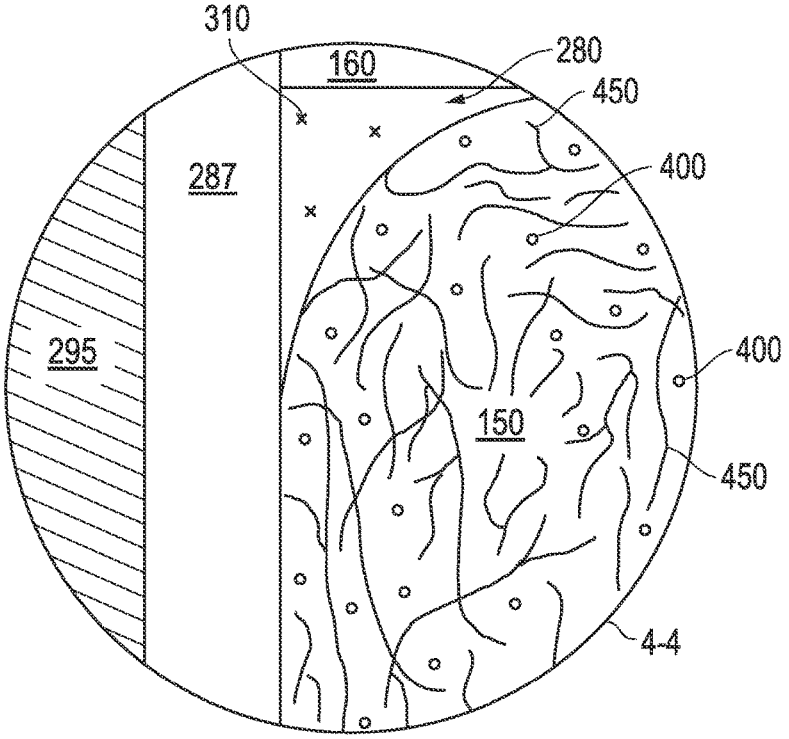
FIG. 4A is a further enlarged view of FIG. 3, taken from 4-4 thereof, with the seal element of initial comparatively substantial elongation properties.
Figure 4B:
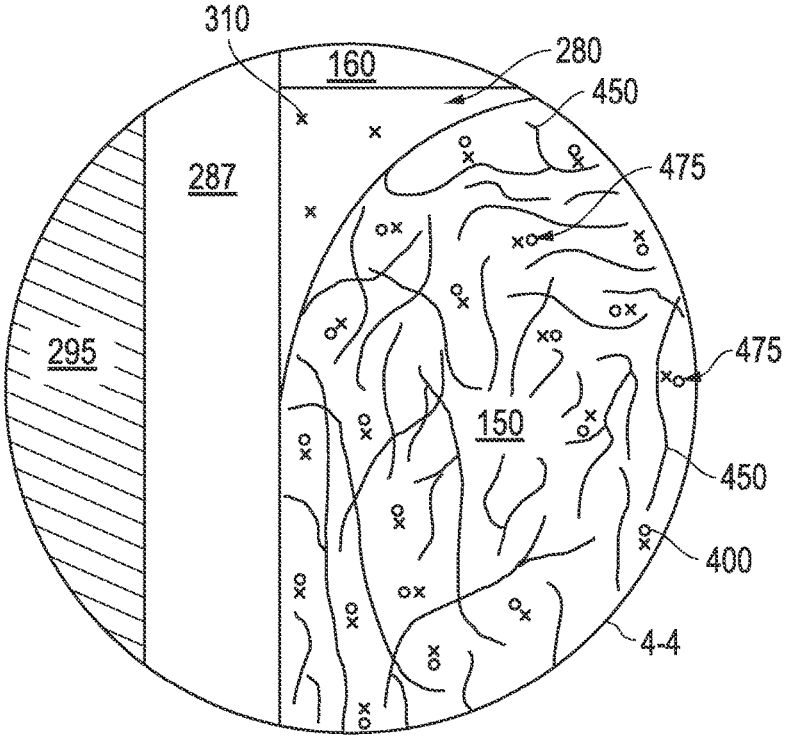
FIG. 4B is the enlarged view of FIG. 4A with the seal element of subsequently less substantial elongation properties.

Referring now to FIGS. 4A and 4B, further enlarged views of FIG. 3, are shown taken from 4-4 thereof. In these depictions, the materials of the seal element 150 are schematically represented in a fashion that reveals different elongation properties thereof. Specifically, FIG. 4A depicts the seal element 150 as initially set with comparatively substantial elongation properties. FIG. 4B, on the other hand, depicts the seal element 150 post stimulation, of subsequently less substantial elongation properties.

With specific reference to FIG. 4A, the seal element 150 is made up of a polymer matrix 450. The material may be a rubber suitable for downhole use. For example, in one embodiment, hydrogenated nitrile butadiene rubber is utilized. However, in other embodiments alternate polymers may be utilized.

Continuing with reference to FIG. 4A, the elastomer matrix of the element 150 is configured to retain, and is infused with, a filler material 400. The filler material 400 may be a constituent or mixture of constituents selected based on capability to reduce the elongation properties of the seal element 150 upon exposure to the wellbore constituents 310. For example, in one embodiment the seal element 150 as depicted in FIG. 4A may be of elongation properties that exceed 200-400% or more as noted above. However, in one embodiment, the filler material 400 may be a cement mix that constitutes up to 40% by volume of the element 150. Thus, after sufficient exposure to the wellbore constituents 310 as detailed below, the elongation properties of the element 150 may be less than about 30-50%. Stated another way, the element 150 may be of substantial elongation properties when set as depicted in FIG. 4A, but subsequently of insubstantial elongation properties as depicted in FIG. 4B.

With specific reference not to FIG. 4B, the seal element 150 is of subsequently less substantial elongation properties as noted above. This is apparent as wellbore constituents 310 begin to penetrate the seal element 150 to form a mix 475 with the filler material 400. So, for example, cement filler material 400 begins to harden upon exposure to water-based wellbore constituents 310. The result affects the polymer matrix 450 such that the overall swell element 150 is substantially hardened. As indicated above, this may leave the element 150 of insubstantial 30-50% elongation properties. In one particular embodiment, the filler material 400 may be a small particle or class H wellbore cement that leads to hardening as noted over the course of less than about three weeks. Regardless of the particular embodiment, the seal element 150 provides sufficient sealing for sake of stimulation applications and is subsequently of sufficient hardness for sake of enhancing drill-out and removal from the wellbore.

Figure 5:
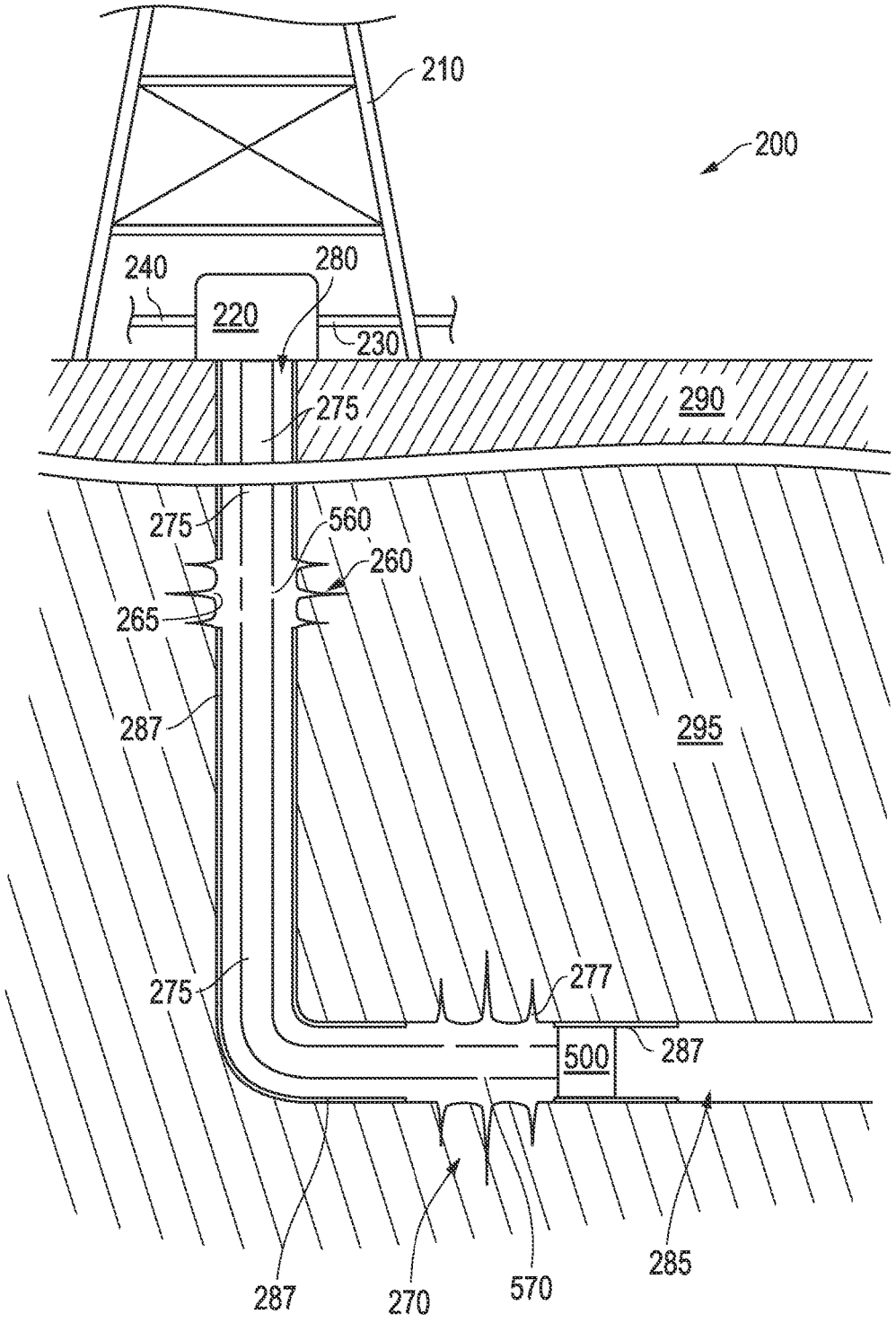
FIG. 5 is another overview depiction of the oilfield with the isolation device drillably removed from the well.

Referring now to FIG. 5, with added reference to FIG. 2, another overview depiction of the oilfield 200 is now shown with the isolation device (e.g. the bridge plug 100) drillably removed from the well 280. This may be achieved by a conventional coiled tubing or tractor driven milling or drill-out application, perhaps utilizing a roller cone bit. Regardless, the plug 100 may be removed in a more timely fashion due to the new hardness of the seal element 150, perhaps a matter of minutes. Perhaps more notably, however, the plug 100 is removed in a fashion that avoids leaving behind large chunks of seal element elastomeric debris. That is, the insubstantial elongation properties of the now harder element 150 promote its disintegration into finer particulate upon drilling and/or milling applications. Stated another way, this material is more readily broken as opposed to torn. Thus, the likelihood of subsequent clogging of surface lines 240 with larger chunks of the drilled element 150 is minimized.

Indeed, continuing with reference to FIG. 5, production tubing 275 may now be extended to traverse both production regions 260, 270 for sake of production without undue concern over unexpected element debris clogging. In the embodiment shown, the tubing 275 is terminated at a packer 500 and includes openings 560, 570 adjacent each respective production region 260, 270. Of course, additional packers for stabilization as well as a host of other architectural features may be provided.

Figure 6:
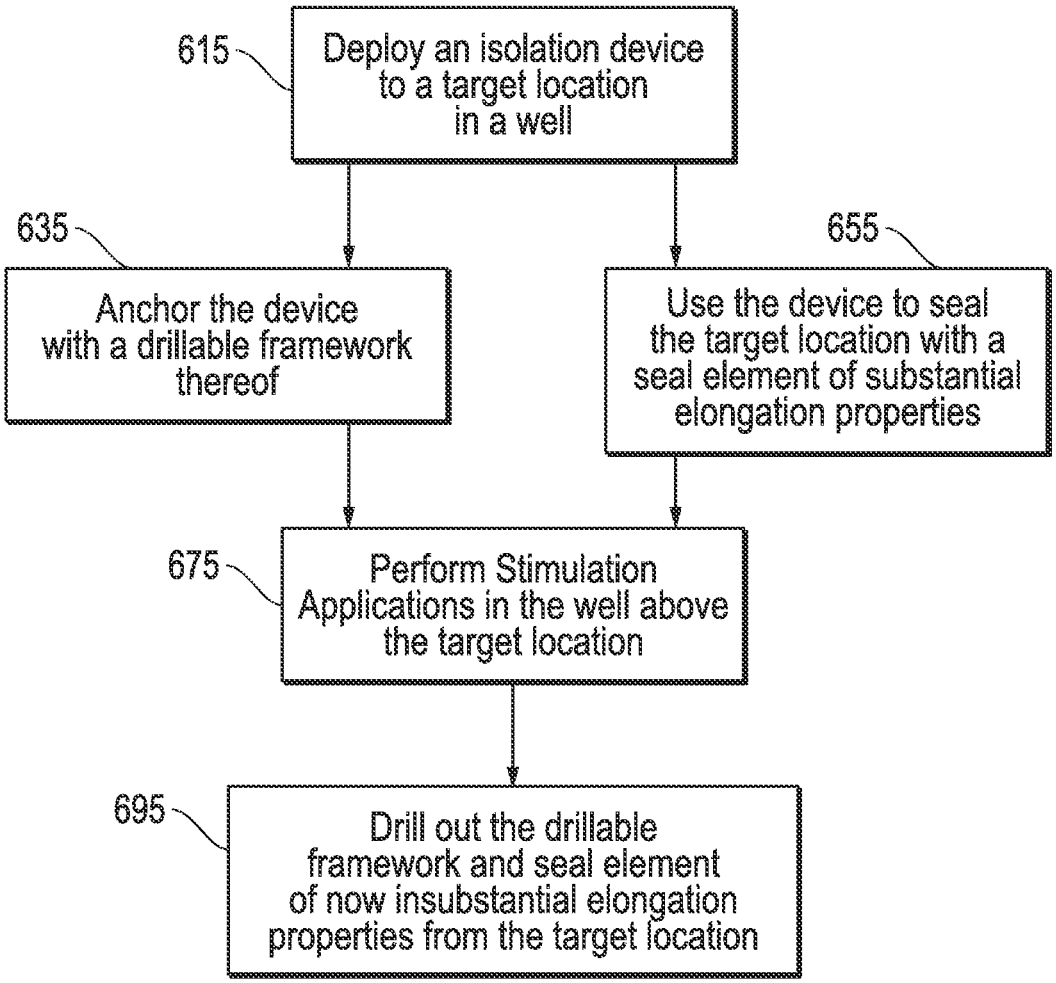
FIG. 6 is a flow-chart summarizing an embodiment of utilizing an isolation device in a well with a seal element of changing elongation properties for downhole hydraulic sealing and subsequent drillable removal.

Referring now to FIG. 6, a flow-chart is shown summarizing an embodiment of utilizing an isolation device such as a bridge plug that includes a seal element of changing elongation properties. The device is deployed to a target location in a well as indicated at 615. Thus, the device may be set in a manner that includes anchoring framework of the device in place (635). That is, slips and a mandrel of the device may combine to structurally hold the set device in place. Once more, as indicated at 655, this setting also includes sealing the target location with a seal element of the device. While the structural framework of the device is initially of a hardness and other drillable characteristics, the seal element is initially of substantial elongation properties for sake of ensuring a high pressure rated hydraulic seal at the target location.

With a reliable seal in place, stimulation applications, such as perforating and fracturing, may take place as indicated at 675. Subsequently, over time, the seal element of the isolation device may transform and take on insubstantial elongation properties as detailed hereinabove. As a result, both the framework of the device as well as the seal element may be considered to be of drillable characteristics. Thus, as noted at 695, they may be drilled out so as to leave the well in an unobstructed condition at the target location.

Embodiments described hereinabove provide a seal element of an isolation device that, once set, effectively seals downhole in the face of substantial pressure differentials such as are found during stimulation operations. That is, as with other more conventional seal elements, embodiments herein may be of substantial elongation properties for sake of effective sealing. However, unlike conventional seal elements, embodiments herein are of changing elongation properties so as to allow for effective drill out following stimulation operations. Specifically, the elongation properties may become insubstantial, allowing the element to be drilled into fine, particles. This avoids the creation of larger chunks of element debris that might otherwise be prone to clog surface equipment when later, and perhaps unexpectedly, produced during well operations.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

I claim:

1. An isolation device for setting at a downhole location in a well and subsequently removing therefrom, the device comprising:

a drillable anchoring framework;

a seal element coupled to said framework, said element of a filler infused elastomer matrix having substantially changeable elongation to break properties; and first and second body portions, said first and second body portions being positioned on opposing sides of said seal element said first body portion having a diameter that is less than a diameter of said seal element, wherein said seal element is of comparatively substantial elongation properties relative said anchoring framework during the setting, the elongation properties being greater than 200%, wherein the seal element is a compressible seal element that achieves sealable setting via compressible forces during the setting, and wherein said seal element is of insubstantial elongation properties during the removing, the insubstantial elongation properties being less than 50%.

2. The isolation device of claim 1 wherein said anchoring framework comprises slips and a mandrel.

3. The isolation device of claim 2 wherein the slips and mandrel are of one of an aluminum based material and a composite based material.

4. The isolation device of claim 1 pressure rated in excess of about 10,000 PSI.

5. The isolation device of claim 1 selected from a group consisting of a packer and a bridge plug.

6. The isolation device of claim 1 wherein the diameter of said first body portion is less than a diameter of said second body portion.

7. A method of temporarily isolating a downhole location in a well, the method comprising:

deploying an isolation device to a target location in a well;

anchoring a drillable framework of the device at the target location;

sealing the target location with a seal element of the device during said anchoring, the seal element having first and second body portions positioned on opposing sides of the seal element the first body portion having a diameter that is less than a diameter of the seal element, the seal element of a filler infused elastomer matrix exhibiting initially substantial elongation to break properties of above 200%, wherein the seal element is a compressible seal element that achieves sealable setting via compressible forces during the setting;

performing a hydraulically isolated application in the well above the target location; and drilling out the device, the filler infused elastomer matrix exhibiting subsequently insubstantial elongation to break properties of less than 50% during said drilling.

8. The method of claim 7 further comprising exposing the seal element to wellbore constituents prior to said drilling for hardening into the insubstantial elongation properties.

9. The method of claim 8 wherein said exposing is for a period of less than about three weeks.

10. The method of claim 8 wherein the wellbore constituents are selected from a group consisting of water, brine and a hydrocarbon.

11. The method of claim 7 wherein said sealing comprises compressibly expanding the seal element into sealing engagement with a casing defining the well at the target location.

12. The method of claim 7 further comprising utilizing a surface line adjacent the well to recover unobstructive fluid production therefrom after said drilling.

13. The method of claim 7 wherein the first body portion is positioned downhole relative to both the seal element and the second body portion.

14. The method of claim 13 wherein the diameter of the first body portion is less than a diameter of the second body portion.

* * * * *